United States Patent [19]

Carlton

[11] Patent Number: 4,613,041

[45] Date of Patent: Sep. 23, 1986

[54] PORTABLE STORAGE KIT FOR HOUSEHOLD CLEANSERS

[76] Inventor: Robert E. Carlton, Rte. 2, Hwy. 58, Boydton, Va. 23917

[21] Appl. No.: 746,104

[22] Filed: Jun. 18, 1985

[51] Int. Cl.[4] ..... B65D 85/28

[52] U.S. Cl. ..... 206/373; 220/23; 220/94 R

[58] Field of Search ..... 206/372, 373, 374; 220/23, 20, 94 R; 211/65, 66, 601

[56] References Cited

U.S. PATENT DOCUMENTS

| | | | |
|---|---|---|---|
| 1,462,245 | 7/1923 | Reglein | 206/373 |
| 2,880,918 | 4/1959 | Schweikhard | 206/373 |
| 2,936,066 | 5/1960 | Meksula | 220/23 |
| 3,887,103 | 6/1975 | Spooner | 206/373 |
| 4,058,210 | 11/1977 | Mitchell | 206/372 |
| 4,285,556 | 8/1981 | Loeffel | 206/372 |

*Primary Examiner*—Joseph Man-Fu Moy
*Attorney, Agent, or Firm*—Larson and Taylor

[57] ABSTRACT

A kit or receptacle for storing and transporting household cleansers is provided which comprises a central carrying section and a pair of side carrying sections hingedly connected to the central section. The end walls of the central section are pentagonal in shape while the end walls of the side sections are of a trapezoidal shape which complements that of one half of the pentagonal end walls of the central section so that a rectangular box is formed when the side sections are pivoted to positions on top of the central section. Spaced vertical partitions are provided in the central section and the ends of a generally U-shaped handle extend through the pentagonal side walls between the partitions a small distance where they are held in place by clips. Grooves in the pentagonal side walls hold the sides of the handles in place.

7 Claims, 6 Drawing Figures

PORTABLE STORAGE KIT FOR HOUSEHOLD CLEANSERS

FIELD OF THE INVENTION

This invention relates to a kit for storing or transporting household cleansers and other cleaning implements safely and conveniently.

BACKGROUND OF THE INVENTION

It is quite common for millions of Americans to purchase and store a large number of all types of liquids or powdered household cleansers. In most cases, the consumer will simply store these products under the kitchen sink, a place which is readily accessible to small children. Liquids or powdered cleansers pose a potentially serious poison hazard to an unwary child who cannot comprehend the danger in swallowing these harmful products.

SUMMARY OF THE INVENTION

An important object of this invention is to provide a storage kit which can store cleansers needed around the house safely, yet can be easily placed out of the reach of small children. The kit is sturdy and is compact enough to be easily carried to whichever room of the house is to be cleaned, thus enabling an adult to keep an eye on the cleansers at all times.

It is another object of this invention to provide a storage kit for household cleansers which can also contain cleaning accessories such as brushes, rags, and the like, which are transported along with the cleansers.

It is further an object of the present invention to provide a kit for keeping household cleansers away from children which is sturdy and safe as well as inexpensive.

In accordance with the invention, a portable storage kit is provided for carrying household cleansers and other cleaning implements, the kit including a main carrying section comprising a rectangular base and four side walls. The side walls comprise a pair of opposing substantially rectangular walls and a pair of opposing walls of substantially pentagonal shape. The main carrying section further comprises a partition means, located between and extending substantially parallel to the opposing rectangular walls, for dividing the main carrying section into two compartments each capable of retaining household cleansers and other cleaning implements, and a generally U-shaped handle. One end of the handle is attached to one of the pentagonal walls and the other end of the handle is attached to the other of the pentagonal walls. The kit further comprises first and second side carrying sections each comprising a rectangular base and four side walls. The side walls of the side carrying sections comprise a pair of opposing walls of substantially trapezoidal shape and a pair of opposing rectangular walls, and define, with the base of the corresponding carrying section, a compartment capable of retaining household cleansers and other cleaning implements. Each of said the carrying sections is hingedly connected to the main carrying section such that the side sections can be moved between a first, open position wherein the side sections are positioned on opposite sides of the main section and the compartments defined by the side sections are exposed, and a second, closed position wherein the side sections are positioned on top of the main container and form therewith a generally rectangular enclosure. The connecting means each comprise a hinged joint located between the upper edge of one of the rectangular walls of the main carrying section and the upper edge of the rectangular wall of the corresponding side carrying section adjacent to that rectangular wall.

Preferably, the partition means comprises first and second rectangular sections vertically spaced apart from each other, and the handle is attached to each of the opposing pentagonal walls at a point between said first and second rectangular sections. Advantageously, the upper portions of the opposing pentagonal walls include means defining central vertically extending grooves therein for receiving the sides of the handle. The handle preferably includes inwardly directed end portions which extend generally parallel to the base of the main section, and the pentagonal walls include openings therein at the lower end of the grooves in which the end portions of the handle are received. Preferably, clips are disposed on the end portions of the handle which are positioned against the inner faces of the opposing pentagonal walls and which retain the handle in place.

Advantageously, a removable insert is located in at least one of the side carrying sections so as to form a compartment capable of retaining cleaning implements in place when that side carrying sections is moved to the second position thereof. The carrying section in which the insert is located preferably includes inwardly extending projections for supporting the insert and the insert includes fingerholes therein.

Other features and advantages of the present invention will be set forth, or apparent from, the detailed description of the preferred embodiments which follows.

DETAILED DESCRIPTION OF THE DRAWINGS

Figure 1:
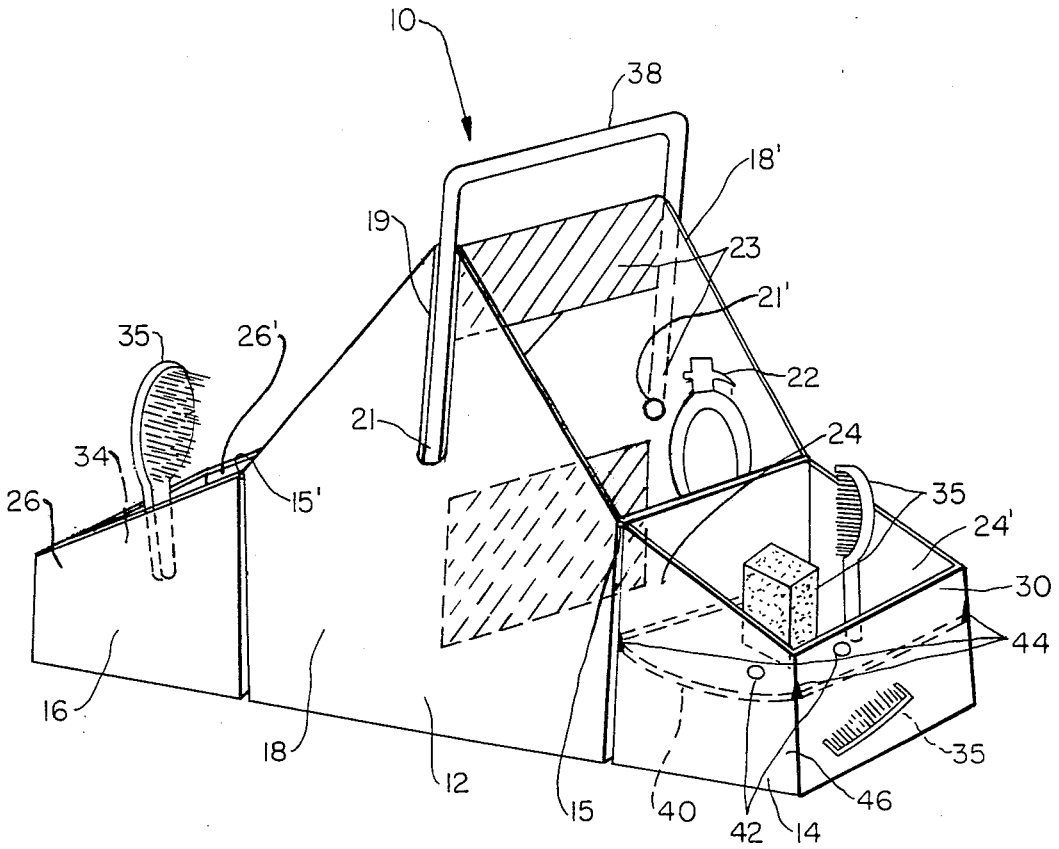
FIG. 1 is a perspective view of a preferred embodiment of the storage kit of the present invention, in the open position thereof.
Figure 2:
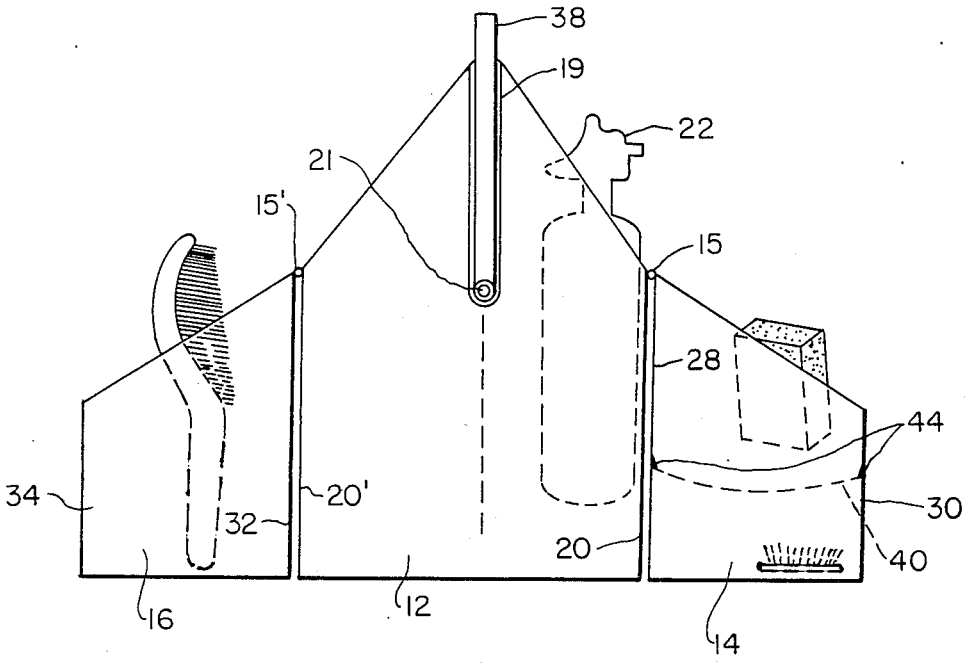
FIG. 2 is a front view of the storage kit in the open position.
Figure 3:
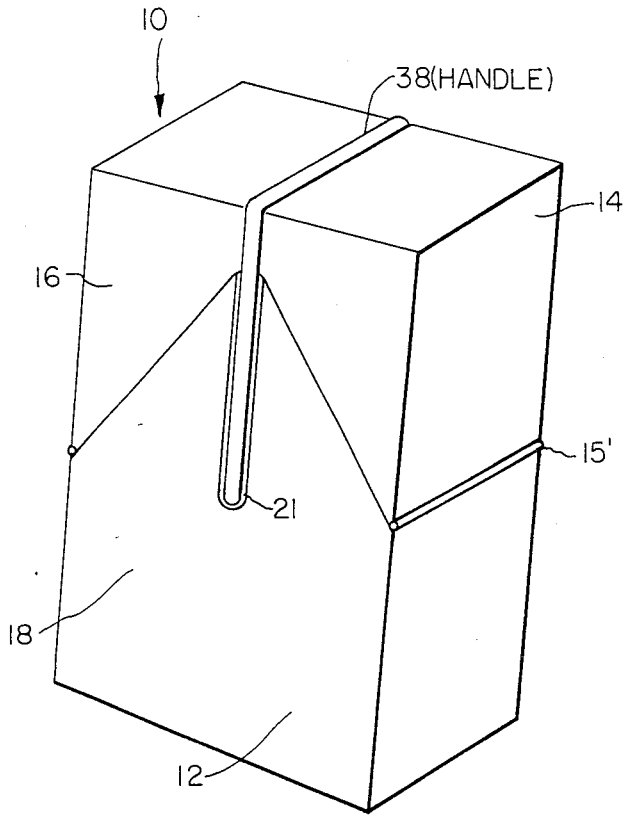
FIG. 3 is a perspective view of the storage kit in the closed position thereof.
Figure 4:
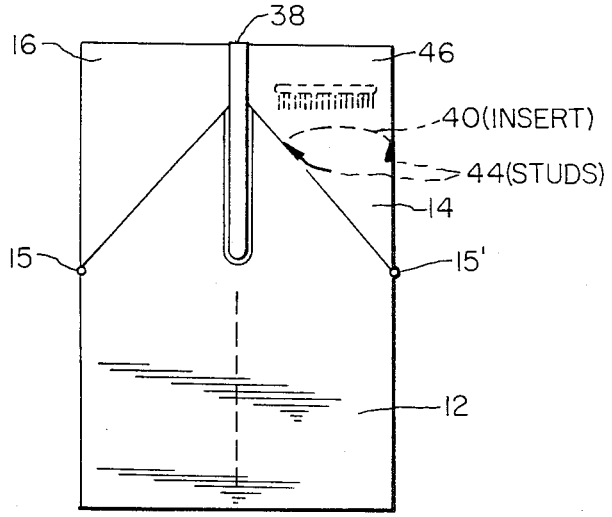
FIG. 4 is a front view of of the storage kit in the closed position.
Figure 5:
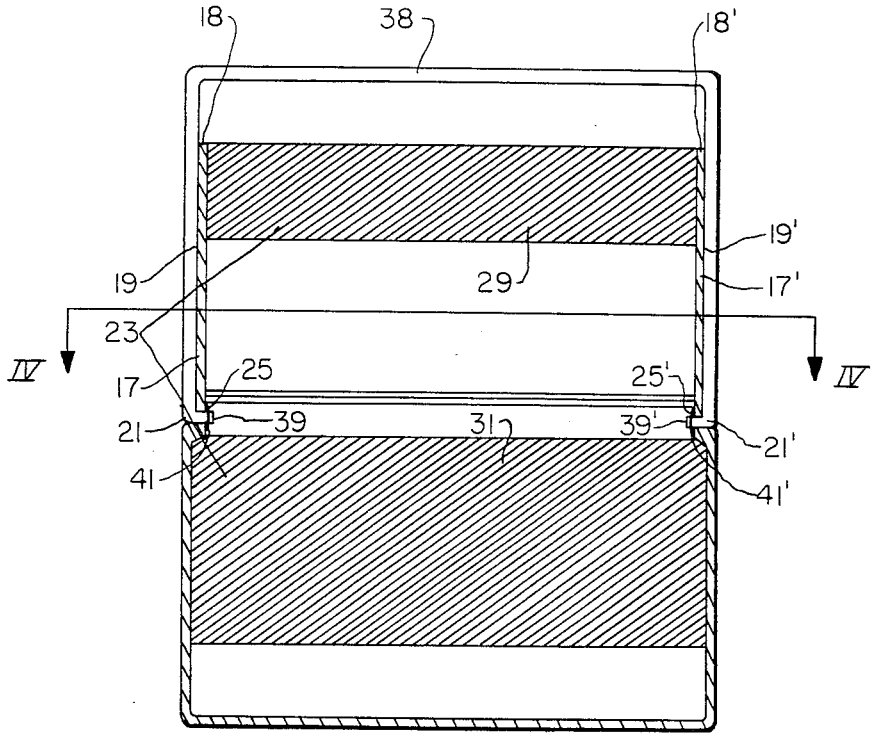
FIG. 5 is a cross sectional view of the storage kit, showing the partitions and the handle attachment.

The storage kit of the present invention is generally denoted 10 and shown in the open position in FIGS. 1 and 2 and the closed position in FIGS. 3 and 4. The kit basically comprises a main carrying section 12 attached to a pair of side carrying sections 14 and 16 by a pair of hinge joints 15 and 15'. The main section is comprised of a pair of opposed walls 18 and 18' of generally pentagonal shape, a pair of opposed walls 20 and 20' of generally rectangular shape, and a partition, generally denoted 23, which divides this main section 12 into two equal compartments each capable of retaining common household cleansers, indicated at 22. The partition 23, which is best observed in FIG. 5, is comprised of top and bottom sections, 29 and 31 with the space between the sections 29 and 31 permitting attachment of a handle 38. The handle 38 is generally in the shape of a "U" and includes inwardly projecting end portions 39 and 39'. Handle 38 is affixed to the main section by placing end portions 39 and 39' through respective holes 21 and 21' in the two opposed pentagonal walls 18 and 18'. This attachment is also best observed in FIG. 5. To maintain the handle in place, fastening means, in the form of star clips 25 and 25' are placed over the end portions 39 and 39'. The handle facilitates carrying of the kit to any desired cleaning area.

Figure 6:
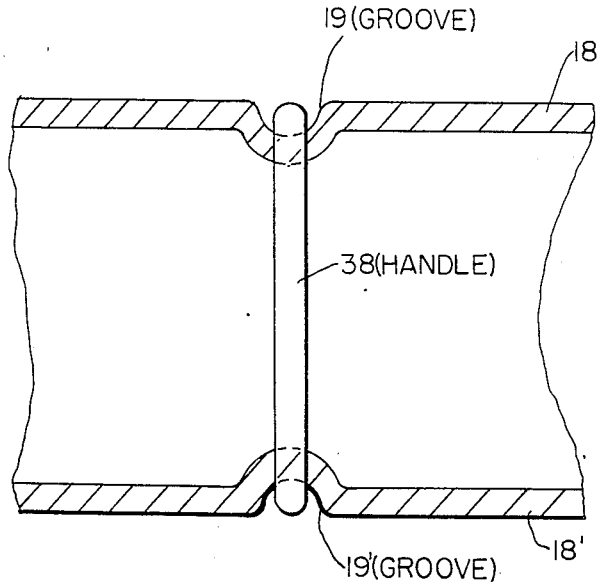
FIG. 6 is a cross sectional view, taken generally along line VI of VI of FIG. 5 and partially broken way.

As is best seen in FIGS. 5 and 6, upper central portions of pentagonal walls 18 and 18' are indented to form grooves 19 and 19'. These grooves 19 and 19' in the pentagonal walls 18 and 18' are provided to accomodate the sides of handle 38 so as to hold the handle 38 in place when the kit is not in use.

The two side carrying sections 14 and 16 are comprised of respective pairs of opposite walls 24 and 24' and 26 and 26' which are of roughly trapezoidal shape, and respective pairs of rectangular walls 28 and 30 and 32 and 34. As illustrated, the rectangular walls 28 and 32 closest to the main section are of greater height than the rectangular walls 30 and 34 furthest away from the main section. These side carrying sections 14 and 16 are also designed for carrying cleansers, and are also ideal for carrying cleaning implements, indicated at 35, such as brushes, washcloths, sponges, and the like.

The kit can be closed by inverting the side carrying stations 14 and 16. The side carrying stations 14 and 16 pivot about hinge joints 15 and 15', respectively, and can be readily brought to a closed position, with each side section inverted upon one half of the main section 12, as shown in FIGS. 3 and 4. While in the closed position, the kit, with cleansers and/or cleaning implements retained thereby, can be stored safely in a place where children cannot reach. As is particularly evident from FIGS. 3 and 4, the size and shape of side carrying sections 14 and 16 relative to handle 38 and the relevant portions of the main section 12 is such that when the side carrying sections 14 and 16 are moved to the closed positions thereof illustrated in FIGS. 3 and 4 rectangular walls 30 and 34 are disposed adjacent to handle 38 on opposite sides thereof, and the base and trapezoidal sidewalls of each of the side carrying sections 14 and 16 lie flush with the handle 38 so that the handle 38 is "nested" with the outer confines of the storage kit and is not exposed for gripping by user. In other words, handle 38 is disposed between the innermost walls of side sections 14 and 16 and lies substantially flush with the exterior surfaces of these sections, and is only exposed for gripping when the kit is opened.

Removable cardboard insert 40 can be disposed in one or both of the side carrying sections 14 and 16 which will allow one to retain cleaning implements in a side compartment when that section has been inverted. Such a cardboard insert 40 is shown in place in side carrying section 14 in FIGS. 1 and 2. Preferably, cardboard insert 40 has finger holes 42 to allow easy placement or removal, with insert 40 being retained and supported by a plurality of studs 44 embedded in the side carrying section 14. The implements 35 can be stored in the compartment 46 formed by insert 40 of side carrying section 14 without these implements falling out when the kit is inverted and brought into the closed position, illustrated in FIG. 4.

The storage kit of the present invention can be made of any lightweight durable materials. It is preferably made of durable hard plastic which is rigid enough to support the various cleansers that fit inside the kit, but is also light enough to allow the kit to be easily transported.

Although the invention has been described relative to exemplary embodiments thereof, it will be understood by those skilled in the art that variations and modifications can be effected in these exemplary embodiments without departing from the scope and spirit of the invention.

I claim:

1. A portable storage kit for carrying household cleaners and other cleaning implements comprising:

a main carrying section comprising a rectangular base and four side walls, said side walls comprising a pair of opposing substantially rectangular walls and a pair of opposing walls of substantially pentagonal shape; said main carrying section further comprising a partition means, located between and extending substantially parallel to said opposing rectangular walls, for dividing said main carrying section into two compartments each capable of retaining household cleaners and other cleaning implements, and a generally U-shaped handle, one end of said handle being attached to one of said pentagonal walls and the other end of said handle being attached to the other of said pentagonal walls; and first and second side carrying sections each comprising a rectangular base and four side walls, said side walls of said side carrying sections comprising a pair of opposing walls of substantially trapezoidal shape and a pair of opposing rectangular walls and defining with the base of the corresponding carrying section a compartment capable of retaining household cleansers and other cleaning implements, means for hingedly connecting each of said side carrying section to said main carrying section such that the side sections can be moved between a first, open position wherein the side sections are positioned on opposite sides of the main section and the compartments defined by the side sections are exposed and the base of each side carrying section lies substantially flush with the base of the main carrying section, and a second, closed position wherein in the side sections are positioned on top of the main container and form therewith a generally rectangular enclosure, said connecting means each comprising a hinged joint located between the upper edge of one of the rectangular walls of said main carrying section and the upper edge of the rectangular wall of the corresponding side carrying section adjacent to that rectangular wall, said side carrying sections being of the same size and this size being such that when the side carrying sections are moved to the second, closed position thereof, one of the rectangular walls of each said side carrying section is disposed adjacent to said handle on each side thereof, and the base and trapezoidal side walls of each of said side carrying sections lie substantially flush with said handle so that the handle is not exposed for gripping by user, said kit further comprising means for mounting said handle on said main carrying section so as to prevent movement of the handle in the direction which the sides of the U-shaped handle extend.

2. A portable storage kit as claimed in claim 1 wherein the partition means comprises first and second rectangular sections vertically spaced apart from each other and wherein the handle is attached to each of the opposing pentagonal walls at a point between said first and second rectangular sections.

3. A portable storage kit as claimed in claim 2 wherein upper portions of the opposing pentagonal walls include means defining central grooves therein for receiving the sides of the handle.

4. A portable storage kit as claimed in claim 3 wherein said handle includes inwardly directed end portions which extend generally parallel to the base of the main section, and said pentagonal walls include openings therein at the lower end of the grooves in which said end portions of the grooves are received.

5. A portable storage kit as claimed in claim 4 wherein said mounting means for said handle include a pair of clips, disposed on the end portions of the handle and bearing against the inner faces of said opposing pentagonal walls, for retaining said handle in place.

6. A portable storage kit as claimed in claim 1 further comprising a removable insert located in at least one of said side carrying sections so as to form a compartment capable of retaining cleaning implements when said side carrying section is moved to the second position thereof.

7. A portable storage kit as claimed in claim 6 wherein said carrying section in which said insert is located includes projections in opposed walls thereof for supporting said insert and said insert includes finger-holes therein.

* * * * *